United States Patent [19]

Schwauss

[11] 4,193,594

[45] Mar. 18, 1980

[54] PARLOR GAME

[76] Inventor: Waldemar B. Schwauss, P.O. Box 21, Hornepayne, Ontario, Canada, POM 1ZO

[21] Appl. No.: 875,186

[22] Filed: Feb. 6, 1978

[51] Int. Cl.[2] ..... A63F 9/06

[52] U.S. Cl. ..... 273/1 R; 35/22 R; 248/473

[58] Field of Search ..... 273/1 R, 1 E, 1 M, 94, 273/93 R; 248/473, 454, 441 R; 35/66, 22 R

[56] References Cited

U.S. PATENT DOCUMENTS

| | | | |
|---|---|---|---|
| 1,386,469 | 8/1921 | Gomoll | 248/473 |
| 1,757,287 | 5/1930 | Mildstein | 35/66 |
| 2,084,802 | 6/1937 | Hamilton et al. | 273/94 R |
| 2,197,483 | 4/1940 | Radzyner | 273/1 R |
| 2,727,742 | 12/1955 | Madsen | 273/93 R |
| 3,114,547 | 12/1963 | Joslyn | 273/1 M |

FOREIGN PATENT DOCUMENTS

| | | | |
|---|---|---|---|
| 113965 | 8/1929 | Austria | 248/454 |
| 641768 | 5/1962 | Canada | 273/1 R |

OTHER PUBLICATIONS

Apparatus, Tests & Supplies for Psychology, Psychometry . . ., Stoelting, C. H., Co. ©1930, pp. 143 & 144.

*Primary Examiner*—Paul E. Shapiro
*Attorney, Agent, or Firm*—Charles W. Chandler

[57] ABSTRACT

A parlor game in which the player marks with a marking instrument a design by viewing a reverse image of the design through a mirror. Several devices for blocking a direct view between the player's eyes and the design are disclosed.

5 Claims, 11 Drawing Figures

PARLOR GAME

BACKGROUND OF THE INVENTION

This invention is related to parlor games of the type in which a player moves a marking instrument about a design viewed through a mirror, and more particularly, to such a game in which the design is hidden from the eyes of the player by a variety of novel means so that he can view only the design's mirror image.

SUMMARY OF THE INVENTION

The broad purpose of the present invention is to provide an improvement over games in which a design is traced by the player viewing the image of the design through a mirror. In the preferred embodiment of the invention, the mirror is adjustable with respect to the design such that the user can adjust the image according to the position of his eyes with respect to the design.

Another object of the invention is to provide such a parlor game in which the design is formed on a pressure-sensitive material on which the user forms a visible mark as he traces a path about a design.

Still another object is to provide such a parlor game in which a shield disposed between the player's eyes and the design is mounted on the marking instrument.

Still another object is to provide such a parlor game in which the mirror is mounted on the shield which is carried by the marking instrument.

Still further objects and advantages will become readily apparent to those skilled in the art to which this invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
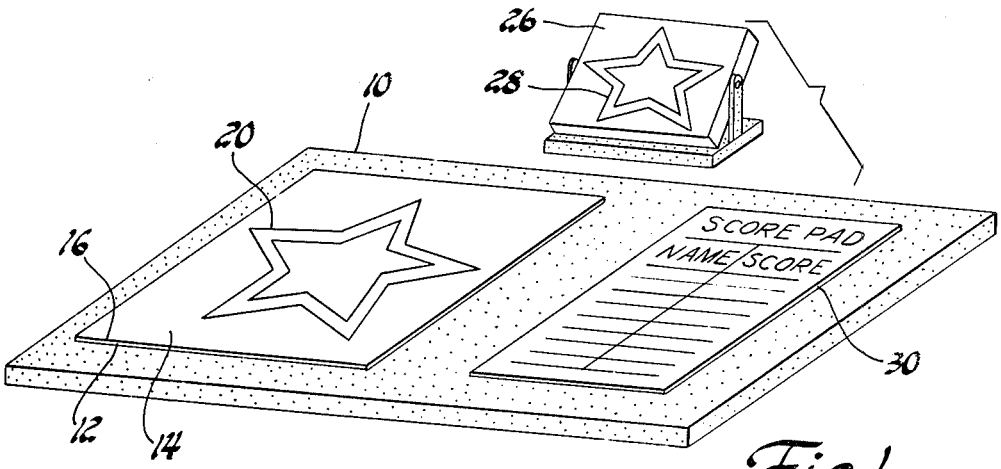
FIG. 1 is a perspective view of a preferred playing board having a design, and a mirror mounted adjacent the playing board to form a reversed image of the design.
Figure 2:
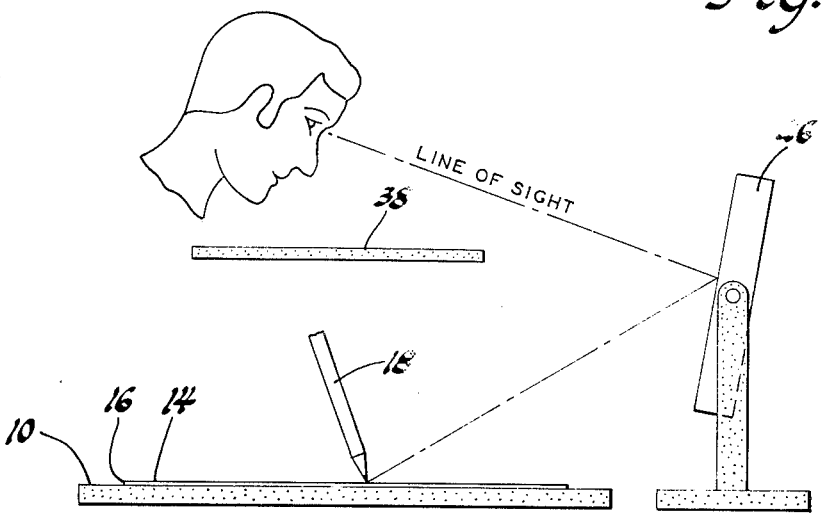
FIG. 2 is a view illustrating the manner in which the user views the reversed image in the mirror.

Referring to the drawings, FIG. 1 illustrates a playing board 10 supporting a pressure-sensitive sheet 12 beneath a transparent plastic sheet 14. Sheet 12 and sheet 14 have similar dimensions.

Figure 3:
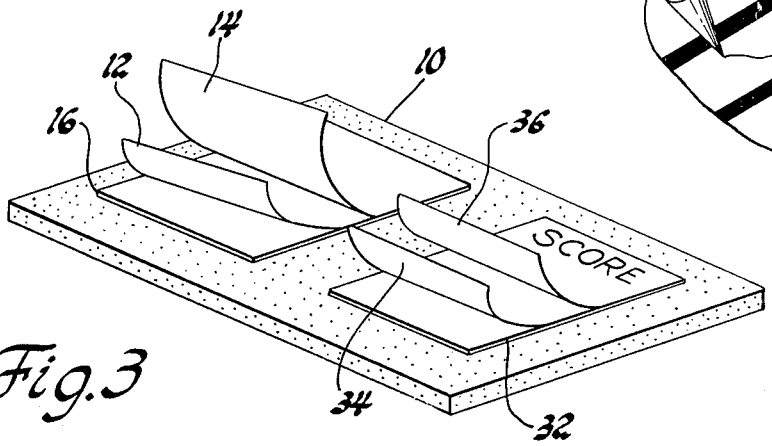
FIG. 3 shows the manner in which both the design material, as well as the scoring material can be manipulated to remove the marks formed during the course of a game.

Referring to FIG. 3, board 10 has a base sheet 16 mounted beneath sheets 12 and 14. Base sheet 16 has a waxy substance on a black background adapted to cooperate with translucent sheet 12 to form a mark when pressure is applied as by a marking instrument 18.

Figure 4:
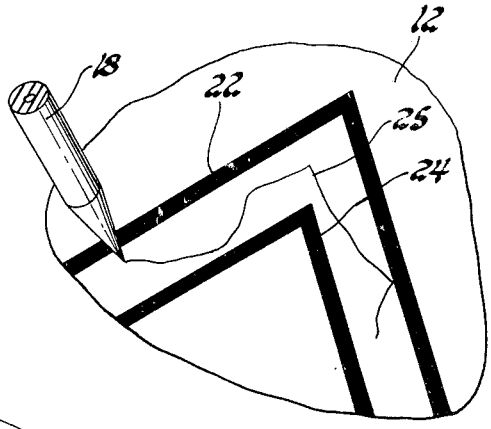
FIG. 4 is an enlarged view of a portion of the design showing the manner in which a mark is traced about the design.

Sheet 12 has a design 20 defined by a pair of parallel lines referred to respectively as outer line 22 and inner line 24. The two lines define a closed path. Although the design illustrated in FIG. 1 is a star-shaped design, a variety of other interesting designs can be employed. Top sheet 14 is preferably formed of a relatively smooth transparent plastic material which permits the user to move marking instrument 18 between the lines of the design to form mark 25, as illustrated in FIG. 4.

A mirror 26 is mounted adjacent playing board 10 to form a reversed image 28 of design 20. The mirror is tiltable with respect to the playing board 10 so that it can be adjusted according to the height of the user's eyes above the playing board.

Referring to FIGS. 1 and 3, scoring means 30 is also mounted on playing board 10 adjacent base sheet 16 and comprises a base 32 having a waxy substance on a black background to cooperate with an intermediate sheet 34 of translucent material and a top sheet 36. Top sheet 36 is a transparent, relatively smooth plastic material which allows the user to employ marking instrument 18 in forming a score on intermediate sheet 34 which cooperates with base 10 to form a temporary mark representing the score. The user can separate top sheet 36 and intermediate sheet 34 from base 32 to remove the score for a new game.

In use, the user places mirror 26 in any desired position with respect to design 20 and then employs a shield 38 between the design and the user's eyes so that he can view the image of the design only through the mirror. He then moves the marking instrument between the parallel lines of the design to form mark 25 on sheet 12. When he has completed the circuit, the player totals up the number of times mark 25 has touched either inner line 24 or outer line 22 and records the score on the scoring means. The next player then takes his turn in a similar manner after separating sheets 12 and 14 from base 16 to remove the mark of the previous player.

After all the players have completed a turn, they can either move the mirror to a different position with respect to the design or substitute for sheet 12 a sheet having a different design, and start a new sequence of turns.

Figure 5:
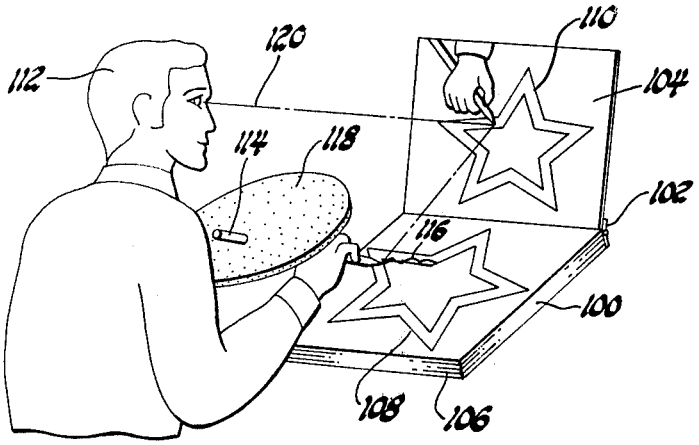
FIG. 5 is a view illustrating another embodiment of the invention in which the design is mounted on disposable sheets, and a shield is mounted on the top of the marking instrument.

Referring to FIG. 5, another embodiment of the invention is illustrated as comprising a game board 100 formed with hinged means 102 which permits the game board to be either folded flat or the upper half bent to a desired angular relationship with respect to the lower half.

Preferably an acrylic reflective material 104 is mounted on the upper half and a plurality of disposable sheets 106 mounted on the lower half. Each sheet 106 has a design 108 which forms a mirror image 110 on reflective sheet 104. Each sheet has the same design so that each player encounters the same difficulty in tracing the design, however, it is to be understood that the sheets could each have a different design so that the user can progress through a variety of designs.

In this embodiment, user 112 employs a pencil 114 to form mark 116 between the parallel lines of design 108. A circular shield 118 is mounted on the upper end of pencil 114 so that the user can grasp the pencil between the shield and the pencil's lower marking end. The player can view the mirror-image only by a line of sight 120 reflected off sheet 104 because shield 118 is disposed between the player's eyes and the design.

Figure 6:
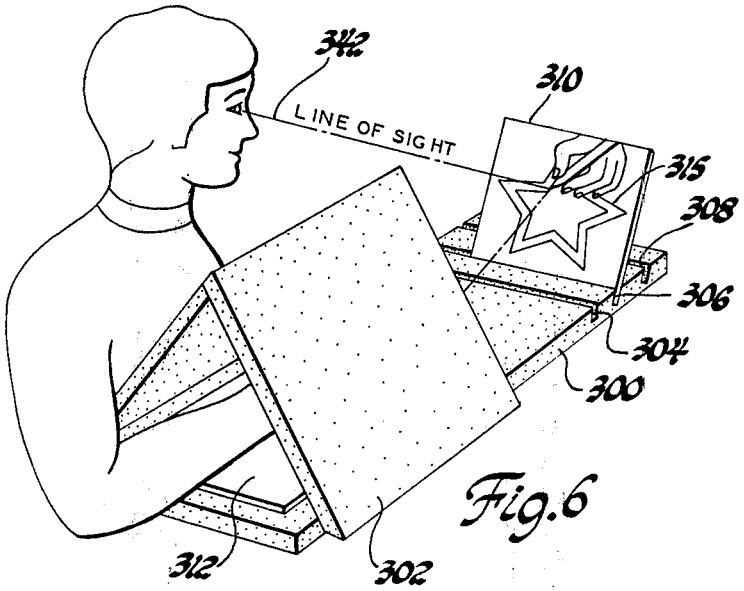
FIG. 6 shows another embodiment of the invention.
Figure 7:
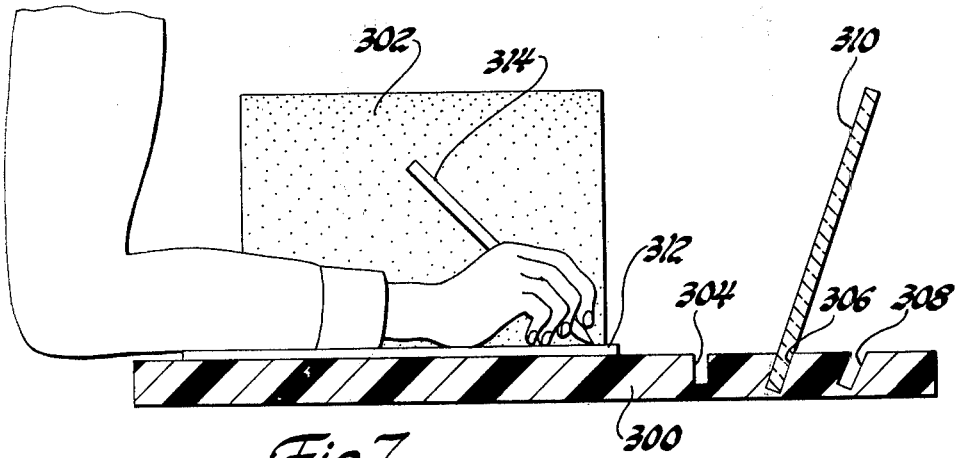
FIG. 7 is a sectional view of the embodiment of FIG. 6 to illustrate the manner in which the mirror can be mounted at a selected angle.
Figure 8:
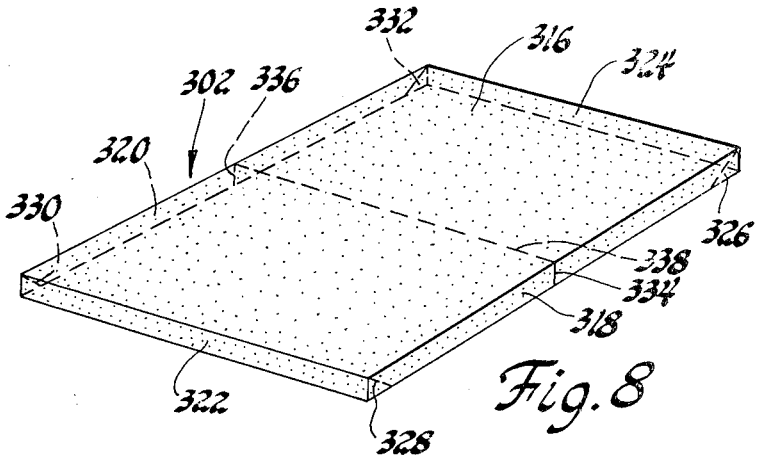
FIG. 8 is a view showing the cover of the game folded to form the shield of FIG. 6.

Referring to FIGS. 6 through 8, another embodiment of the game is illustrated comprising a base 300 and a cover 302. The cover and the base form a container for carrying the game components. The base has a rectangular shape and three slots 304, 306, and 308. The slots are each formed to open at different angular relationships with respect to the base.

A mirror 310 is received in a selected one of the base slots. A game sheet 312 is mounted on the base adjacent the mirror. A marking instrument 314 is employed for tracing the outline of a design on the game sheet in the manner illustrated in the embodiment of FIG. 1.

A design 315, printed on the game sheet, is reflected in mirror 310 as illustrated in FIG. 6.

As illustrated in FIG. 8, box top 302 comprises a cardboard member having a planar body 316, a pair of downwardly depending sides 318 and 320, and a pair of downwardly depending ends 322 and 324. Side 318 has a pair of diagonal fold lines 326 and 328, and side 320 has a corresponding pair of fold lines 330 and 332 adapted to be folded away from the body 316 in such a manner that ends 322 and 324 can be tucked beneath the body.

A pair of score lines 334 and 336 are formed adjacent the midsection of sides 318 and 320, opposite the ends of fold lines 338, which permits the user to fold the box about its midsection at a 90° angle, as illustrated in FIG. 6, to form a shield over game sheet 312.

The user 340 then arranges mirror 310 such that image 315 is suitably reflected in the mirror depending upon the angle defined between the mirror and the user's line-of-sight 342.

Figure 9:
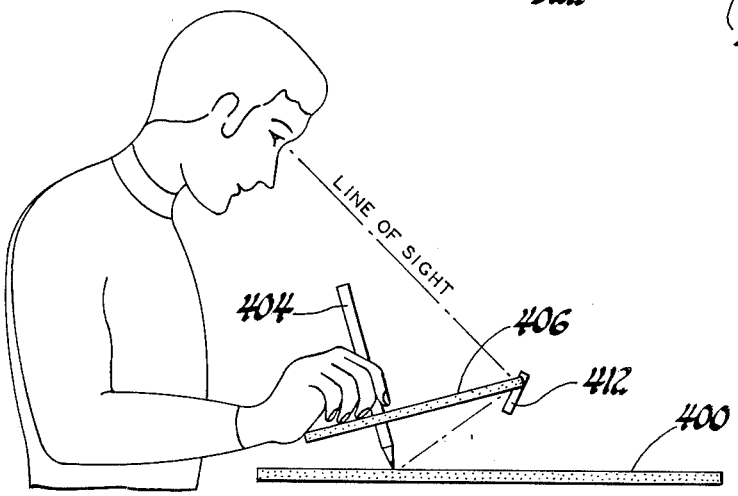
FIG. 9 shows still another embodiment in which the shield is mounted on the marking instrument.
Figure 10:
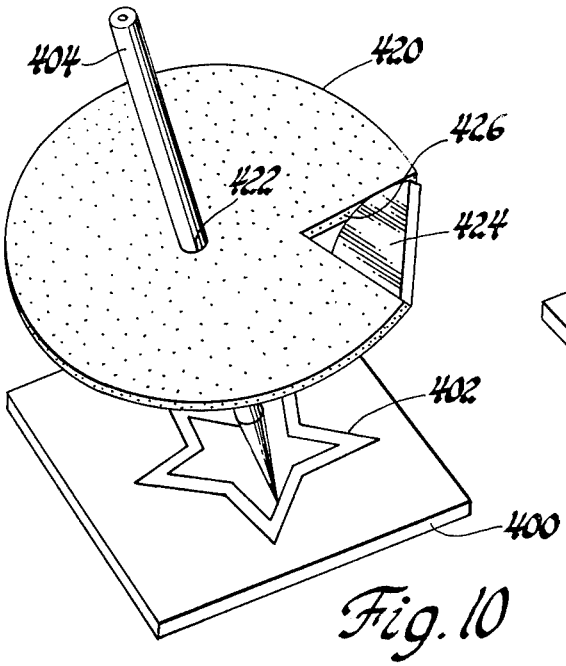
FIG. 10 is a perspective view of the shield of FIG. 9.

FIGS. 9 and 10 illustrate still another embodiment of the invention comprising a game sheet 400 having an appropriate design 402. A marking instrument 404 is employed for tracing the design on game sheet 400 in the manner heretofore described. An elongated, somewhat egg-shaped shield 406 has an opening 408 for receiving marking instrument 404. A second opening 410 is formed at the opposite end of the shield. A mirror 412 has its upper edge attached to shield 406 to close the open side of opening 410. The mirror is connected at an angle with respect to the shield so that the user 414 can view design 402 by a line-of-sight reflected off mirror 412 as illustrated in FIG. 9.

Figure 11:
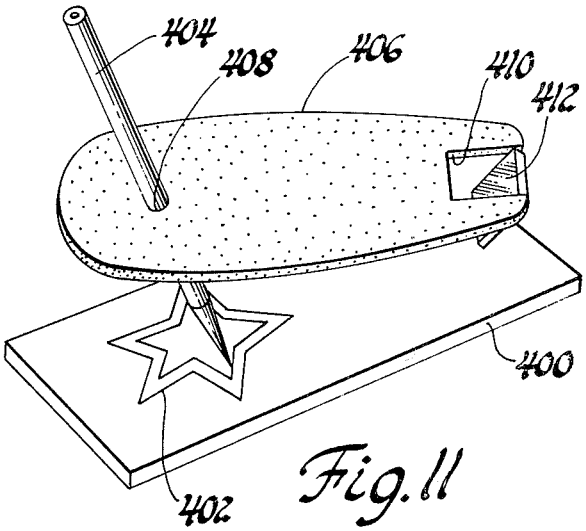
FIG. 11 is another version of the embodiment of FIG. 9.

FIG. 11 shows another version of this embodiment in which shield 420 has been mounted on marking instrument 404 rather than shield 406. Shield 420 has a circular configuration with central opening 422 for receiving the marking instrument. A mirror 424 is mounted adjacent an opening 426 which allows the user to view the lower marking end of marking instrument 404 from a position above the shield. The angular relationship of the line of the sight from the user's eyes to the design differs from shield 406 because the mirror is closer to the marking instrument. This version of the game also contemplates forming several peripheral openings in shield 420 with a different mirror mounted across each opening, each mirror being disposed at a different angular relationship with respect to the shield to accommodate different distances between the user's eyes and the game sheet.

Having described my invention, I claim:

1. A parlor game comprising:

a playing board having a design;

reflective means mounted adjacent the playing board to form a mirror image of the design;

a marking instrument having a marking end for a player to trace the design; and a shield mounted on the marking instrument so as to be movable therewith, and so disposed between the player's eyes and the design whereby the player can view the marking end of the marking instrument only through the reflective means.

2. A parlor game as defined in claim 1, in which the shield comprises a planar member mounted on the marking instrument so as to permit the user to grip the marking instrument in a position between the shield and the marking end of the marking instrument.

3. A parlor game as defined in claim 1, in which:

the playing board has a base, the design being mounted on the base;

the playing board has an upright wall, the reflective means being mounted on the wall; and means for adjusting the inclination between the reflective means and the base to accomodate the distance between the player's eyes and said design.

4. A parlor game comprising:

a playing board;

a marking instrument having a marking pen for a player to form a mark on the playing board;

a shield mounted on the marking instrument so as to be movable therewith and disposed between the player's eyes and the marking end of said instrument; and reflective means mounted on the shield such that the player can view the marking end of the marking instrument through the image thereof in the reflective means at such times as the shield is disposed between the player's eyes and the marking end of said marking instrument.

5. A parlor game as defined in claim 4 in which the shield comprises a planar member, and the reflective means comprises a second planar member mounted at a predetermined angle with respect to the shield.

* * * * *